United States Patent [19]

Sato et al.

[11] Patent Number: 4,850,930

[45] Date of Patent: Jul. 25, 1989

[54] ANIMATED TOY

[75] Inventors: Akihiro Sato; Hidehiko Yamaguchi, both of Tateishi, Japan

[73] Assignee: Tomy Kogyo Co., Inc., Tokyo, Japan

[21] Appl. No.: 6,429

[22] Filed: Jan. 23, 1987

[30] Foreign Application Priority Data

Feb. 10, 1986 [JP] Japan ..... 61-16809[U]

[51] Int. Cl.[4] ..... A63H 3/28

[52] U.S. Cl. ..... 446/175; 446/301

[58] Field of Search ..... 446/175, 301, 303, 297, 446/298, 299, 300; 40/457, 416, 414; 455/344

[56] References Cited

U.S. PATENT DOCUMENTS

| | | | |
|---|---|---|---|
| 2,324,774 | 7/1943 | Henry | 446/175 X |
| 2,953,869 | 9/1960 | Collischan | 446/301 X |
| 3,277,594 | 10/1966 | Rogers et al. | 40/457 |
| 3,469,039 | 9/1969 | Lee | 360/8 |
| 3,662,374 | 5/1972 | Harrison, II | 340/324 A |
| 4,139,968 | 2/1979 | Milner | 446/301 |
| 4,177,589 | 12/1979 | Villa | 40/457 |
| 4,207,704 | 6/1980 | Akiyama | 446/301 |
| 4,579,540 | 4/1986 | Ho | 446/301 |
| 4,665,640 | 5/1987 | Forsse et al. | 446/301 X |

FOREIGN PATENT DOCUMENTS

| | | | |
|---|---|---|---|
| 492633 | 2/1930 | Fed. Rep. of Germany | 40/457 |
| 701036 | 12/1953 | United Kingdom . | |
| 965916 | 8/1964 | United Kingdom . | |
| 1260142 | 1/1972 | United Kingdom . | |
| 2008419 | 6/1979 | United Kingdom . | |

*Primary Examiner*—Mickey Yu

*Attorney, Agent, or Firm*—Staas & Halsey

[57] ABSTRACT

An animated toy is described, including a voice input device for receiving a voice signal transmitted from outside the toy; a driving circuit which shapes a waveform of the voice signal input from the voice input device to output a drive signal; and a driving mechanism which actuates a movable portion of the toy in response to the drive signal from the driving circuit and is returned to its initial stop position when no drive signal is supplied.

8 Claims, 5 Drawing Sheets

ANIMATED TOY

BACKGROUND OF THE INVENTION

This invention relates to animated toys, and more particularly, to a toy which is capable of motions which are synchronized with an external voice signal.

Toys are known which are remote-controlled by means of sound. That is, portions of the toys, such as the wheels of a vehicle or the hands of a doll, are operated by converting an external sound into an electric signal to drive a motor. In such toys, however, the sound usually serves only to start or stop operations, in between which, the movable portions cyclically repeat fixed motions. Further, since the motions are not synchronized with the sound, the motions are not proportional to a variable sound, such as the changing volume of a human voice.

SUMMARY OF THE INVENTION

Accordingly, it is an object of the present invention to provide a toy which can be of a small size and simple in structure, but yet performs motions synchronously with a variable external voice input.

To achieve the foregoing and other objects of the present invention and in accordance with the purposes of the invention there is provided a toy, including: voice input means for receiving a voice or a voice signal transmitted from outside of the toy; a driving circuit which shapes a waveform of a voice signal input from said voice input means to output a drive signal; and a driving mechanism which actuates a movable portion of the toy in response to the drive signal from said driving circuit and is returned to its initial stop position when no drive signal is supplied.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

The preferred embodiments of the present invention will now be described with reference to the drawings.

Figure 1A:
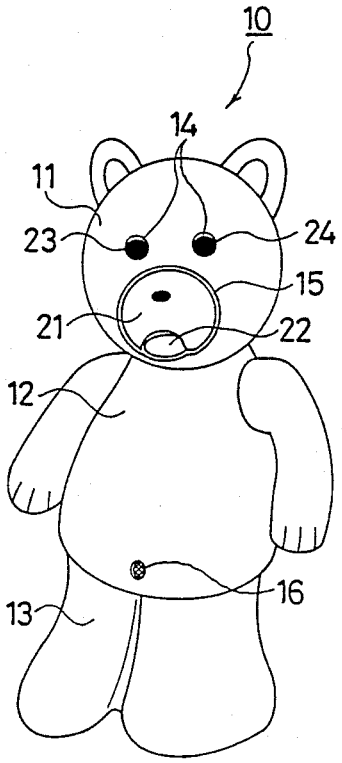
FIG. 1(A) is a front perspective view of the preferred embodiment of the animated toy according to the present invention, illustrating particularly certain eye and mouth movements of the toy.

FIGS. 1(A) and (B) are front perspective views of the animated toy 10 according to the present invention which opens and closes its mouth synchronously in response to an external voice. Although the animated toy 10 is shown configured as a bear-like animal, it is to be understood that other configurations can be adopted, such as other animals, human-like dolls or robot-like creatures.

Figure 1B:
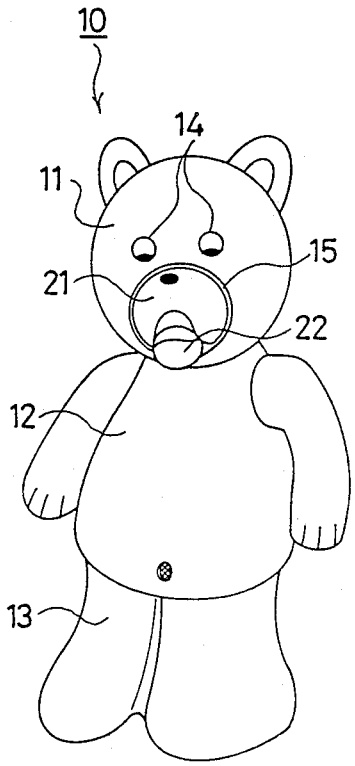
FIG. 1(B) is a front perspective view of the animated toy shown in FIG. 1(A), illustrating particularly other movements of the eyes and mouth of the toy.

FIG. 1(A) shows a first state, wherein the mouth is closed due to no voice input, and FIG. 1(B) shows a second state, wherein a voice input is received by the animated toy 10, the mouth is opened and the eyes are closed in accordance with the loudness of the voice input. A particularly unique feature of this animated toy 10 is that, since the mouth opens and closes synchronously with a voice emitted from a human being or other external sound source, it appears as if the animated toy 10 were speaking to the human being by moving its mouth and eyes.

The animal toy 10 includes a head portion 11, a body portion 12 having two arms attached thereto, and a leg portion 13, all of which are preferably formed hollow of a plastic material. The head portion 11 includes right and left openings 14 and a mouth 15. The mouth 15 includes upper and lower movable members 21 and 22, respectively. Right and left spherical members, 23 and 24, respectively, constitute the eyes and are partially visible through the openings 14. At the front lower portion of the body portion 12 an opening 16 is formed corresponding to a navel for inputting a voice to a microphone 26 which will be described later.

Figure 2:
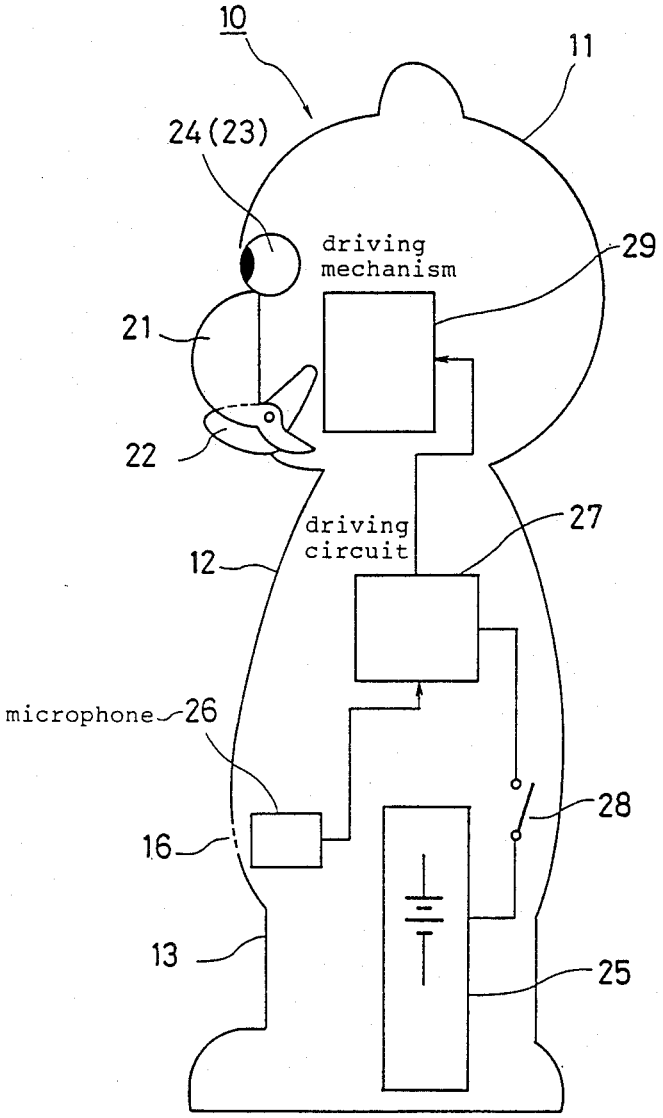
FIG. 2 is a side, cross-sectional, schematic view of the animated toy according to the present invention.

As shown in FIG. 2, inside the leg portion 13 and the body portion 12 there are provided a battery box 25 for receiving a battery as a power source, a microphone 26 positioned at the opening 16 and constituting the voice input means and a driving circuit 27 which shapes a waveform of a voice signal input from the microphone 26 to output a drive signal. A battery voltage is supplied to the driving circuit 27 through a power source switch 28 which can be manually operated between ON and OFF positions from outside the animated toy 10. Inside the head portion 11 there is provided a driving mechanism 29 including a motor 41 (see FIGS. 3 and 4) to be driven by the drive signal output from the driving circuit 27, whereby the movable members 21 and 22 of the mouth 15 and the spherical members 23 and 24 constituting the eyes are actuated.

The various movable portions and the driving mechanism 29 of the animated toy 10 will now be described in greater detail.

Figure 3:
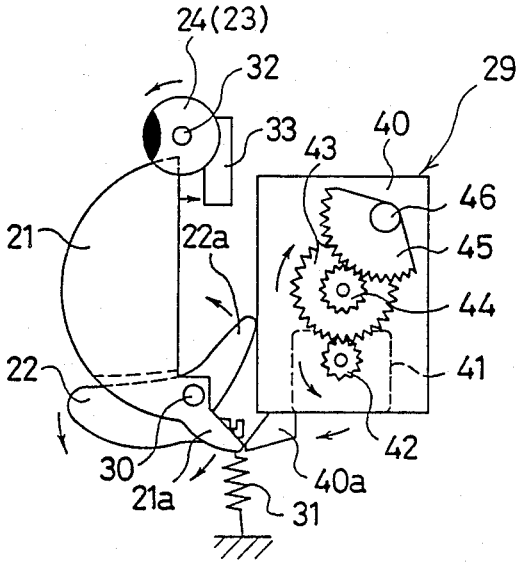
FIG. 3 is a side view of the movable portions of the present invention and the related driving mechanism.

As shown in FIG. 3, the upper movable member 21 is formed as a semispherical shell with a portion constituting a mouth opening being removed. The interior of the shell faces inward of the head 11. The upper movable member 21 is rotatable vertically about a transverse shaft 30 which passes through the lower end portion of the upper movable member 21. A portion of the lower end of the upper movable member 21 extends inward and downward of the head portion 11 to form a projection 21a.

On the other hand, the lower movable member 22 is formed substantially flat and nearly oval and is vertically rotatable about the transverse shaft 30 common to the upper movable member 21. A portion of the inner side of the lower movable member 22 extends inward and upward of the head portion 11 to form a projection 22a. A spring 31 is mounted to extend between a portion of the lower movable member 22 located inwardly with respect to the transverse shaft 30 and the inner wall of the head 11 to pull the lower portion of the lower movable member 22 such that the mouth 15 of the animated toy 10 is normally closed as shown in FIG. 1(A).

The two spherical members 23 and 24 constituting the movable eyes are arranged to be rotatable about a transverse shaft 32 disposed above the mouth 15 within the head portion 11 and are spaced apart a predetermined distance from each other. On the transverse shaft 32 extending between the two spherical eye members 23 and 24, there is mounted a positioning member 33 for positioning a portion of each spherical member which is colored in black at the opening 14 of the head 11.

The driving mechanism 29 which operates the foregoing movable portions has a frame member 40 in the shape of a rectangular parallelepiped and includes the motor 41 at its inner and lower portion. The frame member 40 rotatably supports a gear 43 of a relatively large diameter meshing with a pinion 42 fixedly mounted on the shaft of the motor 41. A gear 44 of a smaller diameter is coaxially mounted with the gear 43 and meshes with a sector-shaped gear 45 mounted on a shaft 46 behind the movable members 21 and 22. Normally, the front surface of the frame member 40 contacts the projection 22*a* of the lower movable member 22 and a projection 40*a* extending forward from the lower end of the frame 40 contacts the projection 21*a* of the upper movable member 21 so as to normally keep the upper and lower movable members 21 and 22 closed.

In this condition, when the shaft of the motor 41 is rotated in the direction of the arrow nearest thereto in FIG. 3 (counterclockwise) in response to the drive signal from the driving circuit 27, the coaxial gears 43 and 44 are rotated in the clockwise direction, as indicated by the arrow nearest thereto. Since the sector-shaped gear 45 engaging the gear 44 is fixed to the head portion 11 by the shaft 46, the whole of the frame member 40 is rotated about the shaft 46 in the counterclockwise direction shown in FIG. 3. Accordingly, as the projections 21*a* and 22*a* are respectively pushed in the directions of the arrows nearest thereto in FIG. 3, the upper and lower movable members 21 and 22, respectively, are rotated vertically about the transverse shaft 30, so that the mouth 15 is opened as shown in FIG. 1(B).

Further, when the upper movable member 21 rotates, its upper end contacts the positioning member 33 of the transverse shaft 32 to push the positioning member 33 rearward. Thus, the spherical members 23 and 24 are rotated in the counterclockwise direction in FIG. 3 through the transverse shaft 32 to move their respective black portions downward. Accordingly, the animated toy 10 closes its eyes as shown in FIG. 1(B).

These motions of the mouth 15 and eyes 23, 24 are performed synchronously with a voice input and the amount of their movements are determined in accordance with levels of the voice input, as described more fully below.

When the motor 41 is stopped in response to the drive signal, the frame member 40 returns to its initial position by its own weight. Accordingly, the pair of movable eye members 23 and 24, respectively, rotate in the reverse directions about the transverse shaft 30, so that the mouth 15 is again closed and the eyes 23, 24 are opened as shown in FIG. 1(A).

As mentioned above, the frame member 40, the motor 41 and the various gears mounted thereto constitute a mechanism which turns in response to the voice signal. By the operation of this turnable mechanism, when the animated toy 10 is spoken to by a human being, the animated toy 10 can open and close its mouth 15 with the black portions of the eyes 23, 24 moving, the opening degree and speed thereof depending on the loudness and the length of the voice input, thus leading to an animated toy 10 with an interesting and entertaining operation.

Figure 4:
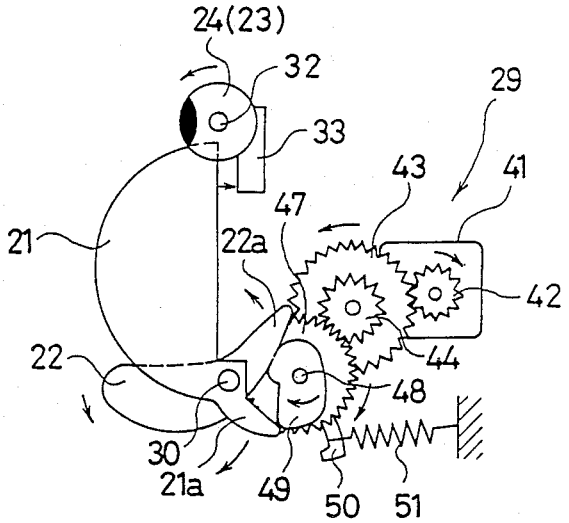
FIG. 4 is a side view of the movable portions of the present invention and the related driving mechanism.

FIG. 4 shows an alternate embodiment of the driving mechanism 29 of the animated toy 10. In this embodiment: the motor 41 is fixed inside the head portion 11; the gear 43 meshes with the pinion 42 which is fixed to the shaft of the motor 41; the gear 44 is mounted coaxially with the gear 43; a cam 49 is fixed to a shaft 48 of a gear 47 meshing with the gear 44; and a spring 51 is mounted between a projection 50 extending downward from the shaft 48 and the inner wall of the head portion 11. The upper and lower movable members 21 and 22 are vertically rotated by the rotation of the cam 49.

More specifically, when the shaft of the motor 41 is not rotated, the cam 49 contacts the projections 21*a* and 22*a* of the movable members to keep the mouth normally closed. Thereafter, when the shaft of the motor 41 is rotated in the direction of the arrow nearest thereto in FIG. 4 (clockwise), the gear 47 and the cam 49 are rotated in the clockwise direction against the pulling force of the spring 51 through the coaxial gears 43 and 44 to push the projections 21*a* and 22*a* of the movable members 21, 22, respectively, in the directions of the arrows nearest thereto in FIG. 4. Accordingly, the mouth 15 is opened and the eyes 23, 24 are rotated as in FIG. 3. When the motor 41 is stopped, the cam 49 is returned to its initial position by the pulling force of the spring 51. Simultaneously the motor shaft is also rotated reversely through the coaxial gears 43 and 44. Thus, the movable members 21 and 22 are respectively rotated reversely about the transverse shaft 30 to be returned to their initial position. These motions are the same as those performed by the turnable mechanism described above relating to FIG. 3.

Figure 5:
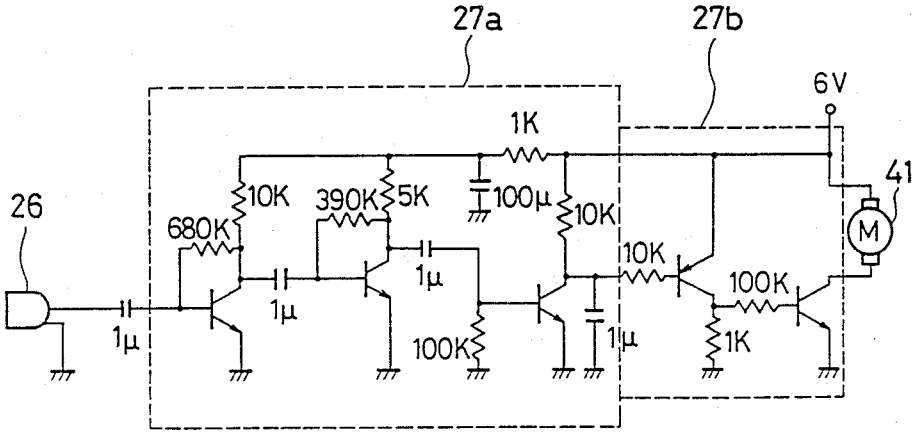
FIG. 5 is a circuit diagram showing an embodiment of the driving circuit of the animated toy shown in FIG. 1.

FIG. 5 shows an example of the driving circuit 27 which shapes a waveform of the voice signal input from the microphone 26 to output the drive signal for rotating the motor 41 of the driving mechanism 29. This driving circuit 27 includes a waveform shaping circuit 27*a* which detects and amplifies the voice signal, and a switching circuit 27b which switches a motor drive current between ON and OFF. The driving circuit 27 is operable to rotate the motor 41 intermittently in a fixed direction in accordance with a high or low volume of the voice signal.

Figure 6:
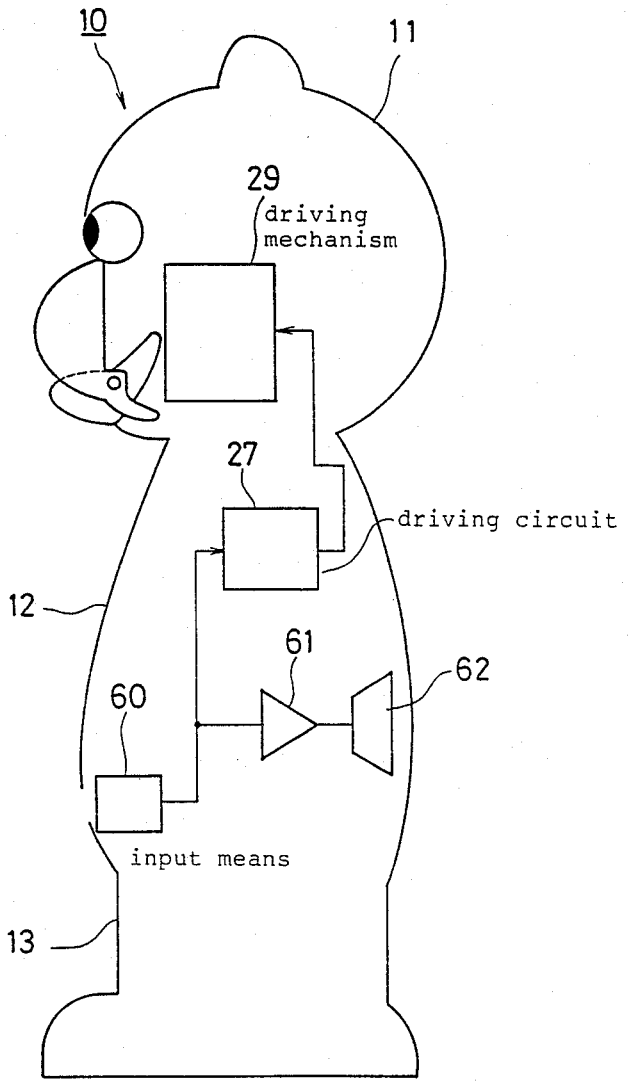
FIG. 6 is a side, cross-sectional, schematic view of another embodiment of the animated toy according to the present invention.

The preferred embodiment of the mechanism and circuitry arranged inside the animated toy 10 of FIG. 1 is described above. However, as the voice input means, a receiver which outputs an electric signal in response to a received voice signal in the form of electric waves or infrared rays, or in the case of a wire communication, a cylindrical input terminal into which a jack attached to one end of a cord can be inserted, may be used instead of the microphone 26. When the voice is not directly input as suggested above, and as shown in FIG. 6, by providing a speaker 62 connected to an output side of the voice signal input means 60 in lieu of the microphone 26 through an amplifier 61 within the animated toy 10, the voice signal can be emitted from inside of the animated toy 10 in response to the voice signal input through wire or wireless, so that it looks as if the animated toy 10 were speaking to itself.

As described above, the toy according to the present invention includes: voice input means for receiving a voice or a voice signal transmitted from outside the toy, a driving circuit for shaping a waveform of the voice signal input from the voice input means to output a drive signal, and a driving mechanism which actuates a movable portion in response to the drive signal from the driving circuit and is returned to its initial stop position when no drive signal is supplied. According to this structure, the toy can be of a small size and simple and further, the toy makes it possible to operate the movable portion almost synchronously with variable voice input, such as words spoken by a human being, so that it is applicable for dolls or animal toys.

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to, falling within the scope of the invention and the appended claims.

We claim:

1. An animated toy, comprising:

(a) voice input means for receiving a voice input having a loudness and for providing an electrical signal;

(b) driving circuit means for shaping a waveform of the electrical signal and for providing a drive signal varying in accordance with the loudness of the voice input and synchronously with the voice input;

(c) a movable portion;

(d) electric motor means, operatively connected to receive the drive signal, for providing a rotational force varying in accordance with the drive signal and in synchronism with the voice input; and (e) a driving mechanism which actuates the movable portion synchronously in response to the voice input and in accordance with the rotational force, said driving mechanism including:

(i) a gear train positioned to engage said electric motor means so as to rotate said movable portion in accordance with the rotational force of said electric motor means; and (ii) a spring which returns said gear train to its initial position when the rotation of said electric motor means is stopped.

2. The toy as recited in claim 1, wherein the voice input means is a microphone.

3. The toy as recited in claim 1, wherein the voice input means is a receiver for receiving the voice signal in the form of electric waves to output an electric signal, and wherein a speaker is incorporated, said speaker converting the electric signal from said receiver into sound signal.

4. The type as recited in claim 1, wherein the voice input means is a receiver for receiving the voice signal in the form of infrared rays to output an electric signal, and wherein a speaker is incorporated, said speaker converting the electric signal from said receiver into sound.

5. The toy as recited in claim 1, wherein the driving mechanism further comprises:

a cam having an initial position and being mounted on said gear train so as to engage said movable portion; and said spring positioned to return said cam to its initial position in response to the drive signal.

6. An animated, bear-like toy, comprising:

(a) a microphone for receiving a voice signal having a loudness and transmitted from outside the toy;

(b) driving circuit means for shaping a waveform of the voice signal and for providing a drive signal varying in accordance with the loudness of the voice signal and synchronously with the voice signal;

(c) a movable portion including a mouth and eyes;

(d) electric motor means, operatively connected to receive the drive signal, for providing a rotational force varying in accordance with the drive signal and in synchronism with the voice signal; and (e) driving mechanism which moves the mouth and eyes synchronously in response to the voice signal and in accordance with the rotational force, said driving mechanism including:

(i) a gear train positioned to engage said motor and said mouth and eyes synchronously in response to the voice signal and in accordance with the rotational force of the motor.

7. The toy as recited in claim 6, wherein said driving mechanism further comprises:

(i) a turntable mechanism having an initial position and which turns in a direction such that said mouth and eyes are moved by the rotational force of said motor and which returns to the initial position in response to the drive signal.

8. The toy as recited in claim 6, wherein the driving mechanism further comprises:

a cam having an initial position and being mounted on said gear train so as to engage said movable portion; and a spring positioned to return said cam to its initial position in response to the drive signal.

* * * * *